US007070525B2

(12) United States Patent
Wilke et al.

(10) Patent No.: US 7,070,525 B2
(45) Date of Patent: Jul. 4, 2006

(54) RACKET FOR BALL GAMES

(75) Inventors: Jürgen Wilke, Wolfurt (AT); Herfried Lammer, Lauterach (AT)

(73) Assignee: Head Technology GmbH, Kennelbach (AT)

( * ) Notice: Subject to any disclaimer, the term of this patent is extended or adjusted under 35 U.S.C. 154(b) by 156 days.

(21) Appl. No.: 10/785,934

(22) Filed: Feb. 26, 2004

(65) Prior Publication Data

US 2004/0229719 A1 Nov. 18, 2004

(30) Foreign Application Priority Data

Feb. 27, 2003 (DE) ..... 103 08 532

(51) Int. Cl.
*A63B 49/02* (2006.01)

(52) U.S. Cl. ..... 473/524; 473/537

(58) Field of Classification Search ..... 473/520, 473/521, 524, 535–537, 546
See application file for complete search history.

(56) References Cited

U.S. PATENT DOCUMENTS

| | | | | |
|---|---|---|---|---|
| 4,343,757 | A * | 8/1982 | Popplewell | 264/221 |
| 4,997,186 | A | 3/1991 | Carr | |
| 5,152,526 | A * | 10/1992 | Soong | 473/537 |
| 5,172,911 | A * | 12/1992 | Chang | 473/521 |
| 5,310,179 | A | 5/1994 | Takatsuka | |
| 5,423,533 | A * | 6/1995 | Hsu | 473/524 |
| 5,462,274 | A * | 10/1995 | Takatsuka | 473/537 |
| 6,293,878 | B1 * | 9/2001 | Iwatsubo et al. | 473/521 |
| 6,623,384 | B1 * | 9/2003 | Kanemitsu | 473/521 |
| 6,761,651 | B1 * | 7/2004 | Pai | 473/545 |
| 2002/0058557 | A1 * | 5/2002 | Kanemitsu | 473/520 |
| 2004/0229719 | A1 * | 11/2004 | Wilke et al. | 473/546 |
| 2005/0197218 | A1 * | 9/2005 | Mauser et al. | 473/520 |

FOREIGN PATENT DOCUMENTS

| | | |
|---|---|---|
| DE | 37 16 708 A 1 | 12/1988 |
| DE | 42 00 078 A 1 | 7/1993 |
| DE | 695 17 619 T 2 | 2/2001 |
| DE | 199 53 626 A 1 | 6/2001 |
| DE | 202 09 723 U 1 | 1/2003 |
| FR | 2 544 208 | 10/1984 |

* cited by examiner

*Primary Examiner*—Raleigh W. Chiu
(74) *Attorney, Agent, or Firm*—Finnegan, Henderson, Farabow, Garrett & Dunner LLP

(57) ABSTRACT

The present invention relates to a racket, in particular a tennis racket or squash racket exhibiting a particularly suitable stiffness and/or strength behavior. For this purpose, the ball game racket of the present invention comprises a racket head, a heart region and a handle portion which together form the frame, wherein in the area of the racket head individual regions are formed which comprise brackets being arranged along the frame in the head region of the racket.

20 Claims, 3 Drawing Sheets

RACKET FOR BALL GAMES

The present invention relates to a racket for ball games, in particular a tennis racket, squash racket, badminton racket and racquet ball racket including a frame comprising a head region for receiving a stringing and a handle or grip portion. Rackets of this kind often have a heart region or a fork adjoining the racket head and merging into the handle portion.

Generally, a struck ball, i.e. a ball hitting the stringing of the racket, causes an elastic deformation of the racket or elastically forces the head region out of its longitudinal axis and leads to a deterioration of the accuracy of aim. Such a deflection of the frame head is i.a. responsible for the direction of a stuck ball. In a ball struck over the entire length of the field, already a slight deflection of the racket head can make the ball hit a point considerably deviating from the actual point of aim. After the ball has deflected the racket, it flies away from the bent or deflected racket. After separation from the ball, the racket starts to vibrate in its free dampened vibration (natural or characteristic frequency).

Moreover, a ball hitting the racket, i.e. a struck ball, causes forces which are transmitted via the racket to the player. Such forces or vibrations or shocks are, at least when acting for a long time, responsible for health problems of the player, such as for instance the so-called tennis elbow.

Furthermore, a continuous compensation of the impact shock and the forces occurring during the game make the player quickly tired. Moreover, the control of the racket and thus the playability behavior are influenced by too strong forces acting on the player.

If the player hits the ball at the so-called sweet spot or in the so-called sweet area, the player only feels a slight impact. However, even with balls struck in this manner, the actual trajectory of the ball can differ from the desired trajectory due to the unfavorable deformation of the racket, and at least in case the player strikes the ball repeatedly or often, the player can suffer from health problems such as the already mentioned tennis elbow.

U.S. Pat. No. 5,462,274 discloses a tennis racket having longitudinal strings stretched in a longitudinal direction and transversal strings stretched in a transversal direction perpendicular to the longitudinal direction, and a ratio of a tensile force exerted on each longitudinal string to a tensile force exerted on each transversal string ranges from 2.5:1 to 4:1 so that a nodal line for vibrations in the secondary mode passes through a sweet area thereby decreasing a reaction from the tennis racket at an impact against a tennis ball.

U.S. Pat. No. 4,997,186 discloses a racket frame, such as for a tennis racket, having a head portion, a handle portion and a throat portion extending therebetween. The head portion encompasses an open region and has a plurality of stringing holes for attaching a stringing to the head portion and across the open region. The throat portion is in the form of a pair of legs in a generally V-shaped configuration. Different cross-sectional dimensional relationships are incorporated in the racket frame to tailor the racket frame stiffness. A first cross-sectional dimensional relationship relates to the location of the maximum cross-sectional height of the racket frame in a lower extent of the head portion thereof so as to define a dual reverse tapered profile along the cross-sectional height of the racket frame. A second cross-sectional dimensional relationship relates to the provision of an abrupt transition in an inwardly facing surface of the head portion of the racket frame so as to define a dual tapered profile along the cross-sectional width of the racket frame head portion. A third cross-sectional dimensional relationship relates to the variation of the cross-sectional height to width along the throat portion of the racket frame so as to define a greater throat portion height and a greater throat portion width near to the handle portion.

U.S. Pat. No. 5,310,179 describes the construction of a tennis racket provided with an oval head frame defining a stringing face, wherein the longitudinal size of the stringing face is set to a value in a range from 320 to 390 mm, and the transverse size of the same is set to a value in a range from 200 to 240 mm, and the longitudinal compressive rigidity of the head frame is adjusted to a value in a range from 30 to 200 kgf/mm. The construction thus specified allows the employment of an enlarged main/cross string tension ratio which assures a high degree of spin performance at shooting balls.

DE-A-199 53 626 describes an improved ball game racket in which a profile, which forms the frame, has different cross-sectional shapes at different frame positions according to the main kinds of stress occurring at these positions, said cross-sectional shapes having a section modulus being adapted to the respective kinds of stress, wherein in the area between four and six o'clock and/or in the heart region of the racket at least one hunch-like stiffening element can be provided.

U.S. Pat. No. 6,293,878 describes a vibration damping element in a sports racket comprising first and second elastic damping materials which can be connected with the racket frame and a mass adding part which can vibrate freely independent of the racket frame and comprises a bracket assembly.

However, the rackets known from the state of the art do not achieve the optimum stiffness or the optimum dampening behavior of a racket so that the hitting accuracy, impact absorption and handleablility or playability characteristics of these known rackets still leave much to be desired. Moreover, the rackets known from the prior art still do not fulfill the possibility of an optimum, simple and/or fast and cost-saving production.

It is the object of the present invention to provide a further improved racket, in particular an improved tennis racket and an improved squash racket. The present invention furthermore aims at providing a racket which overcomes the disadvantages of the state of the art, exhibits an improved stiffness behavior or improved stiffness, can be produced in a simple and cost-saving manner and/or exhibits improved playability characteristics. This object is achieved with the features of the claims.

The invention is based on the concept of providing a ball game racket comprising a frame having a head region for receiving a stringing and a grip or handle portion for holding the ball game racket, wherein in at least two segments of the head region, the frame comprises a plurality of bracket-like or rib-like stiffening elements arranged transversely to the frame.

In this connection, transversely to the frame means approximately perpendicular to a longitudinal axis extending through the frame or through individual regions of the frame or infinitesimal frame elements. Figuratively speaking, such a longitudinal axis follows approximately the frame contour. This means that the stiffening elements generally extend almost radially with respect to a circle formed by the head region, i.e. in the stringing plane and/or perpendicular to the stringing plane. The stiffening elements enclose or surround the frame at least partially and/or completely.

Due to an optimized change in the cross-sectional profile of the racket frame in the head region, the stiffening elements allow a change in the vibration and/or dampening behavior along the frame so that an optimized vibration and/or dampening behavior is achieved. The stiffening elements cause an optimized mass distribution of the entire racket mass and an increase or change in the stiffness of the racket along the contour of the racket. The playability characteristics of the racket can thus be influenced. Moreover, the player subjectively feels a greater sweet spot.

The stiffening elements are arranged in at least two, preferably in four segments of the frame in the head region of the racket, wherein each segment comprises a plurality of stiffening elements, preferably three to five stiffening elements. The segments are preferably provided in the area of about half past three o'clock to five o'clock and seven o'clock to half past eight o'clock or in the area of one o'clock to half past two o'clock and half past nine o'clock to eleven o'clock.

Within one segment, the stiffening elements preferably have different rib or bracket widths and/or different distances between each other, wherein the width of the brackets of a segment preferably increases in the direction of a transverse axis extending approximately centrically through the head region of the racket, i.e. in the direction towards three o'clock or nine o'clock. In this regard, the width of a stiffening element preferably increases with respect to a neighboring stiffening element or the width of a group of stiffening elements preferably increases with respect to a neighboring group of stiffening elements, wherein the width of the individual stiffening elements or the width of the individual stiffening elements of one group of stiffening elements remains unchanged. Preferably, a stiffening element has a greater width than a directly neighboring stiffening element and/or a smaller width than a further directly neighboring stiffening element. Moreover, two neighboring stiffening elements preferably have approximately the same or the same width, wherein, in turn, they have a greater and/or smaller width than a neighboring group of two stiffening elements. Preferably, such a change in the width takes place uniformly along the racket profile or symmetrically with respect to the racket.

The individual segments preferably have a width or length of about 60 to 90 mm, particularly preferably a width of about 70 to 80 mm along the frame or racket contour. The individual brackets or ribs preferably have a width in the range of about 2.5 to 12 mm and particularly preferably in the range of about 4.5 to 9 mm.

Moreover, at the circumference of the frame profile, the brackets have a distance of about 0.25 to 1 mm, preferably about 0.5 mm. Relative to the frame, the brackets preferably have a thickness of about 0.25 to 1 mm, preferably about 0.5 mm, i.e. the surface of the brackets projects from the adjacent surface of the frame by about 0.5 mm. Thus, in the area of a bracket, the radius of the racket frame is increased by about 0.25 to 1 mm, preferably by at least about 0.5 mm.

In a preferred embodiment of the present invention, the bracket-like stiffening elements are integral with the racket. This means that the brackets are preferably realized by the above-mentioned increase in the radius of the racket frame. The changes in the cross-section are selected such that in the transition between the frame profile and the respective bracket they do not have a negative effect, because in case of too great changes the risk of fracture increases as the fibers contained in the frame are bent over, in particular if the brackets or edges and transitions of the brackets have relatively sharp edges. The edges of the cross-sectional profile of the stiffening elements are therefore preferably rounded off.

By providing the described stiffening elements in defined segments along the racket contour of the bead region, i.a. an increased strength or an increase and change in the stiffness of the racket along the frame contour of the head region is achieved, which, in turn, leads to improved playability characteristics. Moreover, since the stiffening elements are integral with the racket, it is possible to produce the racket in a simple and cost-saving manner and, at the same time, the racket properties and mass distribution are optimized.

In the following, a racket of the invention will be described in more detail on the basis of a preferred embodiment and with reference to the drawings in which FIG. 1 is a front view of a prior art ball game racket;

Figure 4A:
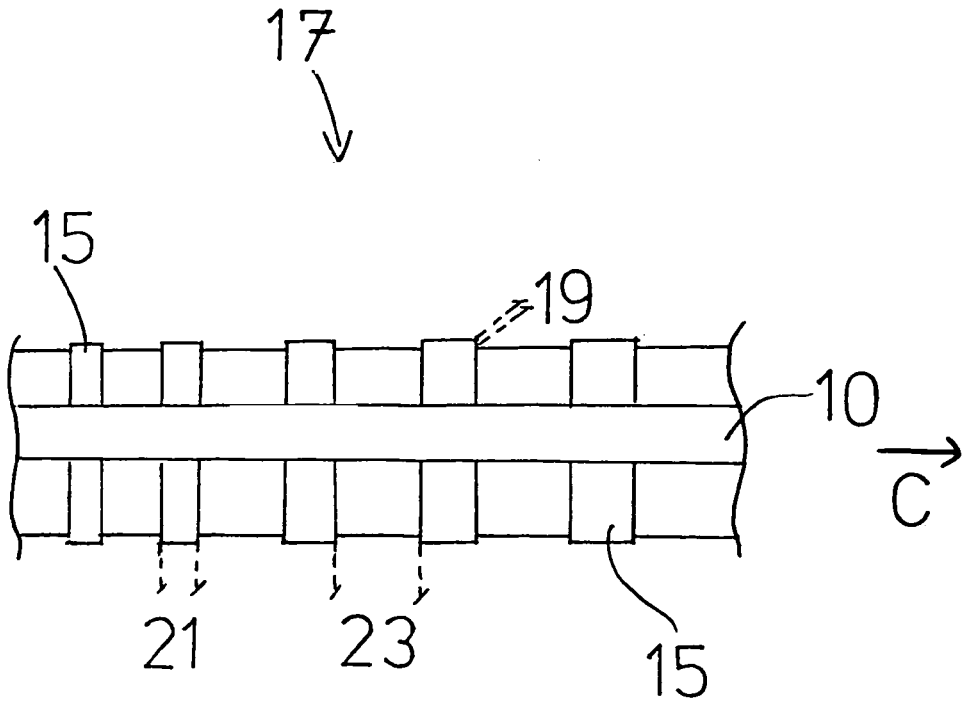
Figure 4B:
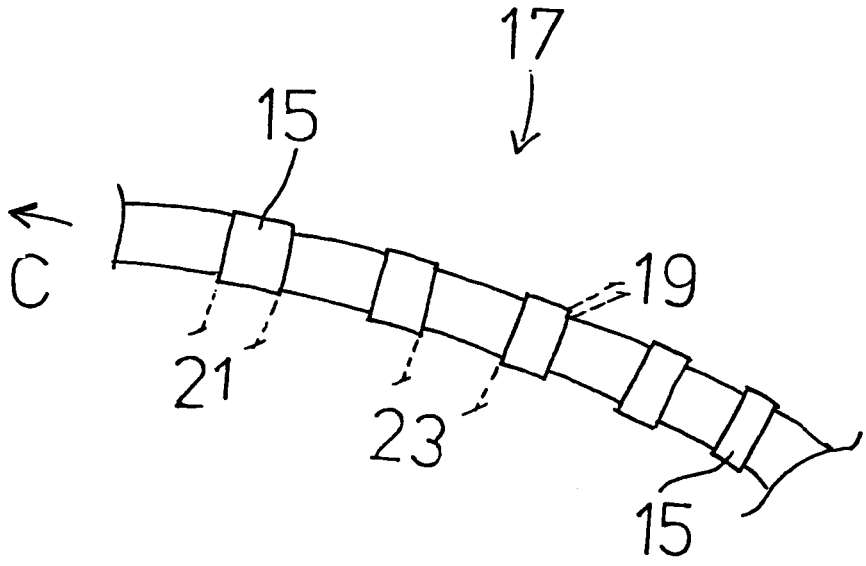

FIG. 4*a* is a detailed top or front view of a segment of a racket of the present invention; and FIG. 4*b* is a detailed side view of a segment of a racket of the present invention.

Figures 1, 2:
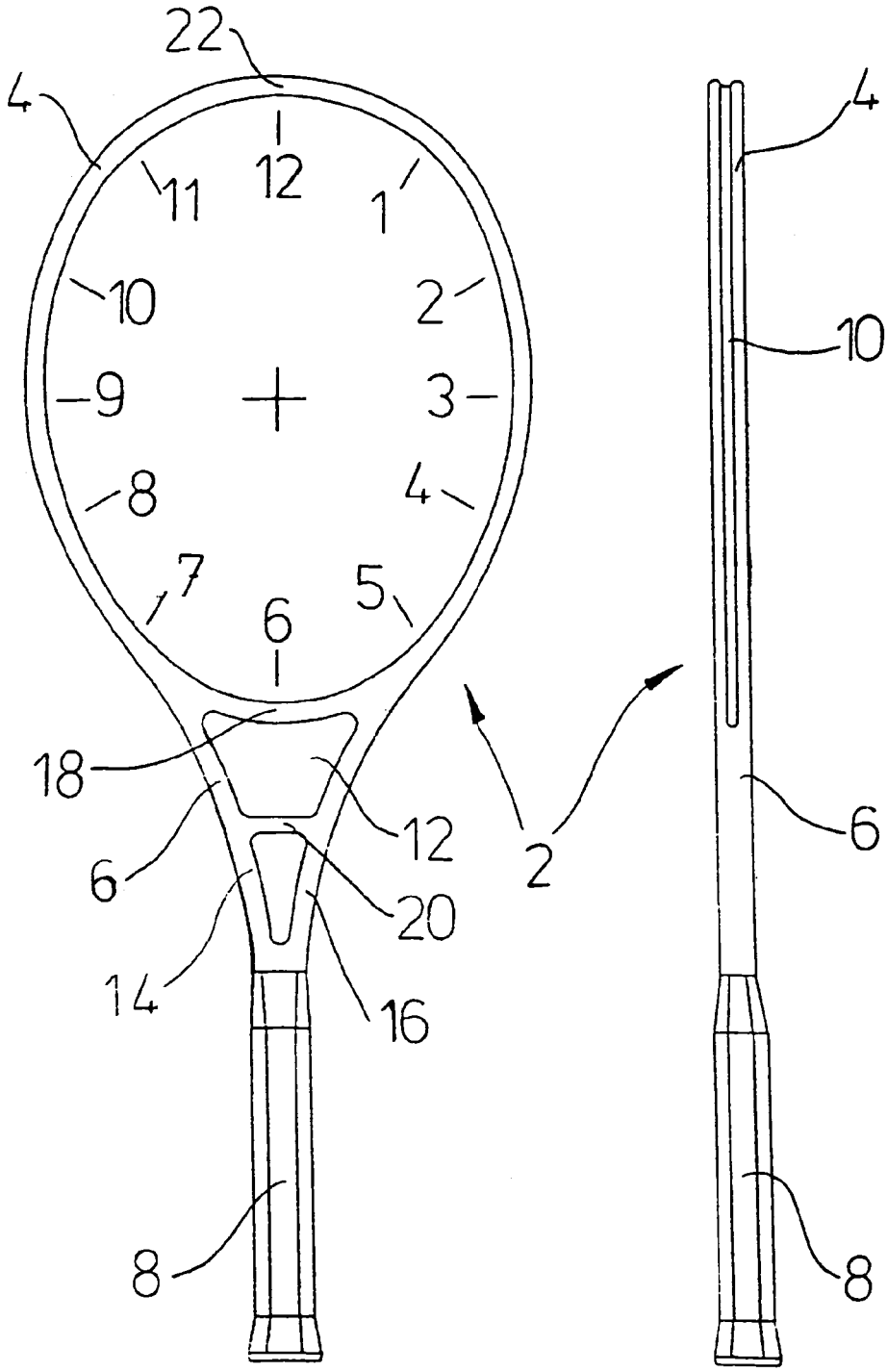
FIG. 1 FIG. 2 PRIOR ART
FIG. 2 is a side view of a ball game racket according to FIG. 1.

FIGS. 1 and 2 show front and side views, respectively, of a conventional ball game racket 2. The ball game racket 2 has a substantially oval racket head 4, a heart region 6 and a handle portion 8. In the head region 4 of the racket 2 usually a groove 10 is provided for receiving a wear frame or head tape, not shown. The heart region 6 of the racket 2 is arranged substantially between, i.e. is the junction area between the head region 4 and the handle portion 8. For example, as shown in FIG. 1, the heart region 6 has an opening 12. This opening is not necessarily required. However, if such an opening 12 is provided, it is in general formed by two lateral portions 14 and 16 as well as a connecting portion or a bridge 18 being arranged in the head region 4 of the racket. Moreover, a second connecting element 20 may be provided for reasons of strength between the two lateral regions 14 and 16 of the heart region 6.

The conventional tennis racket 2 shown in FIGS. 1 and 2 is made of a shaped profile having substantially constant dimensions apart from the groove 10. The cross-sectional shape or the cross-sectional dimensions of the profile forming the racket frame are substantially constant and substantially oval or rectangular from the lateral region 14 of the heart region 6 around the head region 4 to the lateral region 16. Only in the transition area between the heart region 6 and head region 4 or in the receiving area of the connecting element 18 has the racket 2 increased cross-sectional dimensions. As discussed above, there are further racket shapes in which the cross-sectional shapes or the cross-sectional dimensions of the profile forming the racket can undergo the above-mentioned cross-sectional changes.

For a better orientation and for simplifying the determination of specific areas along the frame profile in the head region 4 of a racket 2, a dial of a conventional clock is drawn into the head region 4. It is thus possible to describe the features of a racket of the present invention by referring to the respective circumferential position at the head region 4 of the racket in connection with the respective time. This means that the position at the circumference of the head region 4 of the racket corresponds to the position of the "big hand" at the respective time. "Twelve o-clock", for instance, corresponds to the outermost head end 22 of the racket 2 shown in FIG. 1.

Figure 3:
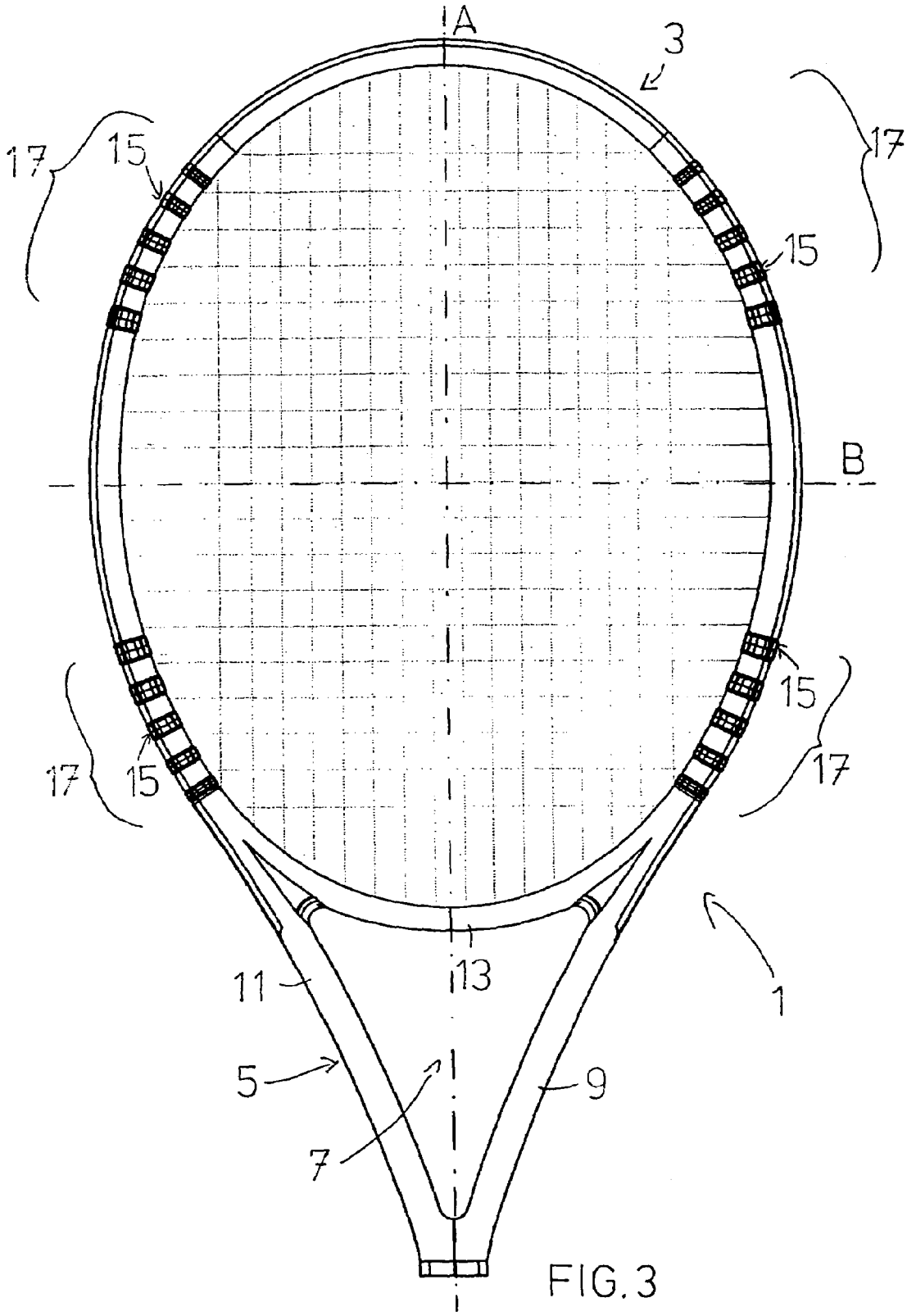
FIG. 3 is a sectional view of a ball game racket according to a preferred embodiment of the present invention.

A preferred embodiment of a ball game racket 1 of the present invention is shown in FIGS. 3 and 4. The basic structure of the racket 1 of the present invention substantially corresponds to that of a conventional ball game racket as described above, e.g., with reference to FIGS. 1 and 2. This means that the racket 1 of the present invention has a head region 3, a heart region 5 as well as a handle portion (not shown). As already described above, the heart region 5 of the racket of the present invention is substantially the junction area between the head region 3 and the handle portion and, for instance, has an opening 7. The opening 7 is formed by two lateral portions 9 and 11 as well as a connecting portion or a bridge 13 in the head region 3 of the racket 1. In contrast to the embodiment depicted in FIG. 3, the heart region 5 of the racket 1 of the present invention can also be designed without the opening 7, i.e. the handle portion may extend solidly to the head region 3. The connecting element or the bridge 13 is likewise optional. Hence, the heart region 5 may also be formed only of the extensions 9 and 11 of the head region, which extend towards the handle portion. Moreover, the heart region 5 may also comprise a second connecting element (not shown), as described above with reference to the prior art racket 2.

As already explained above, the racket 1 of the present invention is based on the concept that stiffening elements in the form of ribs or brackets 15 are provided at specific positions along the frame of the head region 3 of the racket 1, in particular in those segments being subjected to particularly high stress, e.g. in the form of static or dynamic forces and torsional or bending moments, in order to purposefully influence the strength or stiffness of the racket 1 depending on their construction and arrangement.

In the preferred embodiment as shown, the brackets 15 are provided in the segments 17 at about half past three o'clock to five o'clock and seven o'clock to half past eight o'clock or in the area of one o'clock to half past two o'clock and half past nine o'clock to eleven o'clock. In a particularly preferred embodiment of the present invention, in the segments 17 the brackets are arranged at about two o'clock, four o'clock, eight o'clock and ten o'clock. The segments 17 all preferably have a width of about 60 to 90 mm and particularly preferably a width of about 70 to 80 mm. The width of the segments 17 can also be described as the length along the circumference of the frame in the head region 3 of the racket 1. Moreover, the width of the individual brackets is about 2.5 to 11 mm and particularly preferably 4.5 to 9 mm. In the preferred embodiment as shown, the width of the brackets increases in the individual segments in the direction towards three o'clock and nine o'clock.

In a preferred embodiment of the present invention, the distance between the brackets 15 is between 2 and 11 mm, preferably between 4 and 9 mm. In a preferred embodiment of the present invention, the brackets have different distances between each other, i.e. distances increasing and/or decreasing within one segment, preferably also in the direction of the increasing bracket width. This means that the width of and/or distance between the individual stiffening elements or the individual stiffening elements or the groups of stiffening elements within one or more segments is preferably realized in the manner described above with reference to the stiffening elements within one segment.

Preferably, the width of and/or the distance between the stiffening elements, i.e. the individual stiffening elements or a group of stiffening elements increases or decreases with respect to neighboring and/or directly neighboring individual stiffening elements and/or groups of stiffening elements, wherein the width of and/or the distance between the individual stiffening elements or the individual stiffening elements of a group remains the same.

Two corresponding preferred embodiments of the present invention are shown in FIGS. 4*a* and 4*b*, wherein FIG. 4*a* is a detailed top or front view of a segment and FIG. 4*b* is a detailed side view of a further segment. It can easily be taken from these illustrations that the distance 23 between the stiffening elements 15 increases in the direction of the arrow C.

FIGS. 4*a* and 4*b* furthermore show that the width 21 of the individual brackets increases within one segment 17 in the direction of the arrow C. In a preferred embodiment of the present invention, the direction of the arrow C corresponds to the direction towards three o'clock or nine o'clock.

The brackets are formed by a change in the diameter, in particular an increase in the diameter with respect to the frame profile of preferably 0.25 to 1.0 mm, in particular about 0.5 mm. In a particularly preferred embodiment of the present invention, the circumferential profile of the brackets corresponds to the racket profile at the corresponding positions, wherein the radius of the brackets is increased in the circumferential direction by about 0.5 mm with respect to that of the frame profile. In a further embodiment of the present invention, the brackets surround the frame profile at least partially. In a further preferred embodiment of the present invention in which the racket of the present invention has a groove according to groove 10 described in FIG. 2, the brackets 15 are omitted at the positions of the groove 10, i.e. they surround the racket profile only partially. In a further preferred embodiment of the present invention in which the brackets 15 surround the racket profile partially, these brackets 15 do not have abrupt or sudden starting and end points, i.e. there are no clear-cut dividing lines towards the respective cross-sectional profile. In a further preferred embodiment of the present invention, the brackets surround the racket profile completely, i.e. they extend endlessly around the frame profile.

In this connection, FIGS. 4*a* and 4*b* illustrate the circumferential increase in the radius 19 of the brackets or stiffening elements 15 vis-à-vis the respective frame profile. FIG. 4*a* further shows a detailed view of a racket having a groove 10, wherein the stiffening elements 15 are correspondingly omitted at the positions of the grooves 10. In a preferred embodiment of the present invention, the increase in the radius 19 caused by the stiffening elements 15 is reduced in the direction towards the groove 10 so that the increase in the radius 19 is lower in the transition between the stiffening element 15 and the groove 10 than the increase in the radius along the remaining circumference of the frame profile, and is approximately 0 in a particularly preferred embodiment.

The ball game racket of the present invention as shown in FIG. 3 has five brackets 15 in each of the segments 17 at about two o'clock, four o'clock, eight o'clock and ten o'clock, wherein in each of the segments the brackets 15 become wider towards three o'clock and nine o'clock (cf. FIGS. 4*a* and 4*b*). In a preferred embodiment of the present invention, the brackets each widen by the same value, and in a further preferred embodiment of the present invention, they each widen by a corresponding ratio. Accordingly, in an embodiment of the present invention, the brackets each widen, e.g., by half a millimeter, and, in accordance with a further embodiment of the present invention, they widen by 10 to 30% of the width of the previous bracket. In a further preferred embodiment of the present invention, the brackets only widen as a whole within one region, wherein, however, not each bracket widens with respect to a neighboring bracket.

In a further embodiment of the present invention, a ball game racket of the present invention comprises three brackets 15 per segment, according to a further preferred embodiment four brackets 15. Ball game rackets of the present invention which are realized as tennis rackets preferably comprise five brackets 15 per segment 17, while ball game rackets of the present invention which are realized as squash rackets preferably comprise three brackets 15 per segment 17.

According to a preferred embodiment of the present invention, the brackets are integrally formed with the frame of the racket. Alternatively, the brackets can also include different materials, e.g. for achieving additional stiffening effects. If the racket is made of composite fiber materials, the amount of change in the diameter or radius in the area of the brackets is reduced, because due to their general size and dimensions, they can have relatively sharp edges so that the risk of fracture increases as the fibers are bent over. In a preferred embodiment of the present invention, the edges and transitions of the brackets 15 are preferably rounded off so that dangerous stress concentrations in the frame can be avoided.

The racket 1 of the present invention as well as the arrangement and configuration of the brackets is, moreover, preferably substantially symmetrical with respect to a longitudinal center axis A, so that the above-mentioned brackets or bracket segments in the area around about seven or eight and ten or eleven o'clock are symmetrically provided also at corresponding positions between one or two and four or five o'clock, respectively. In a further preferred embodiment of the present invention, the racket 1 of the present invention as well as the arrangement and configuration of the brackets is also preferably substantially symmetrical with respect to a transverse center axis B, so that the above-mentioned brackets or bracket segments in the area around about one or two and ten or eleven o'clock are symmetrically provided also at corresponding positions between four or five and seven or eight o'clock, respectively.

All known materials for tennis, squash, badminton and any other rackets for ball sports are appropriate materials for the racket 1 of the present invention. In particular, the racket 1 of the present invention can be produced of wood, metal, metal alloys, plastics, carbon composite materials, fiber materials, composite materials, and combinations thereof.

Moreover, the invention provides a process for producing a ball game racket comprising a head region along which the brackets are arranged in individual segments and, in particular, a ball game racket according to the above-mentioned preferred embodiments.

A preferred process includes the following steps: First, a plurality of layers of a material are stacked in order to form the frame of the racket. Then, the thus obtained multi-layer structure is placed in a mold having recesses or grooves at the positions corresponding to the brackets or ribs of the racket and subsequently molded and hardened. Afterwards, the ball game racket is removed from the mold. If the brackets are to comprise different materials, the latter can additionally be positioned at corresponding places in the mold.

In a further preferred process of the present invention, the layers of the material forming the racket and the brackets comprise a carbon fiber material which is molded and hardened under an increased temperature and/or increased pressure. In a further process of the present invention, the forming and hardening takes place in a press.

Vis-à-vis the rackets known from the prior art, a ball game racket of the present invention guarantees an improved vibration and/or dampening behavior as well as an improved stiffness. By means of the racket of the present invention the playability behavior can thus be influenced. The player subjectively feels a greater sweet spot. By adapting the configuration and/or arrangement of the brackets of the present invention as well as the described bracket segments, the specific properties and characteristics of the ball game rackets can be adapted to the requirements. The optimized mass distribution moreover allows the provision of a racket exhibiting an excellent stiffness and dynamic behavior while being lightweight at the same time.

The invention claimed is:

1. A ball game racket including a frame comprising a head region for receiving a stringing and a handle portion for holding the ball game racket, wherein in the head region the frame comprises in any one of at least two segments a plurality of stiffening elements extending transversely with respect to the frame and wherein the width of the stiffening elements of one segment increases in the direction towards three o'clock and nine o'clock.

2. The ball game racket according to claim 1, wherein the stiffening elements are provided in four segments.

3. The ball game racket according to claim 1, wherein the segments are spaced apart from each other.

4. The ball game racket according to claim 1, wherein the segments and/or the stiffening elements is/are arranged substantially symmetrically with respect to each other.

5. The ball game racket according to claim 1, wherein stiffening elements are arranged in the racket head in the areas of about half past three o'clock to five o'clock and seven o'clock to half past eight o'clock or in the areas of one o'clock to half past two o'clock and half past nine o'clock and eleven o'clock.

6. The ball game racket according to claim 1, wherein the segments each have a width of about 60 to 90 mm along the racket contour.

7. The ball game racket according to claim 1, wherein the stiffening elements form a circumferential projection on the racket contour of about 0.25 to 1 mm.

8. The ball game racket according to claim 1, wherein the stiffening elements have a width in the range of about 2.5 to 11 mm.

9. The ball game racket according to claim 1, wherein the stiffening elements are spaced from each other by a distance of about 2 mm to about 11 mm.

10. The ball game racket according to claim 1, wherein the racket comprises three to five stiffening elements per segment.

11. The ball game racket according to claim 1, wherein each segment comprises five stiffening elements in case the ball game racket is a tennis racket, and wherein each segment comprises three stiffening elements in case the ball game racket is a squash racket.

12. The ball game racket according to claim 1, wherein the stiffening elements and the frame are made of the same material.

13. The ball game racket according to claim 1, wherein the stiffening elements and the frame are made of different materials.

14. The ball game racket according to claim 1, wherein the stiffening elements are shaped as ribs and/or brackets.

15. The ball game racket according to claim 14, wherein the distance between the stiffening elements formed in one segment increases in the direction towards three o'clock and nine o'clock.

16. A ball game racket including a frame comprising a head region for receiving a stringing and a handle portion for holding the ball game racket, wherein in the head region the frame comprises in any one of at least two segments a plurality of stiffening elements extending transversely with respect to the frame and wherein the distance between the stiffening elements formed in one segment increases in the direction towards three o'clock and nine o'clock.

17. The ball game racket according to claim 16, wherein the stiffening elements formed in one segment all widen in the direction towards three o'clock and nine o'clock.

18. The ball game racket according to claim 16, wherein stiffening elements are arranged in the racket head in the areas of about half past three o'clock to five o'clock and seven o'clock to half past eight o'clock or in the areas of one o'clock to half past two o'clock and half past nine o'clock and eleven o'clock.

19. The ball game racket according to claim 16, wherein the distance between the stiffening elements formed in one segment increases in the direction towards three o'clock and nine o'clock.

20. The ball game racket according to claim 16, wherein the racket comprises three to five stiffening elements per segment.

* * * * *